US010988216B1

(12) United States Patent
Murphy

(10) Patent No.: US 10,988,216 B1
(45) Date of Patent: Apr. 27, 2021

(54) SURFACE PIERCING HYDROFOIL WING

(71) Applicant: Michael J. Murphy, Canyon Lake, CA (US)

(72) Inventor: Michael J. Murphy, Canyon Lake, CA (US)

( * ) Notice: Subject to any disclaimer, the term of this patent is extended or adjusted under 35 U.S.C. 154(b) by 0 days.

(21) Appl. No.: 17/138,518

(22) Filed: Dec. 30, 2020

Related U.S. Application Data

(60) Provisional application No. 62/974,876, filed on Jan. 2, 2020.

(51) Int. Cl.

| | |
|---|---|
| ***B63B 32/60*** | (2020.01) |
| ***B63B 32/50*** | (2020.01) |
| ***B63B 1/26*** | (2006.01) |
| ***B63B 1/24*** | (2020.01) |

(52) U.S. Cl.
CPC ..... *B63B 32/60* (2020.02); *B63B 1/24* (2013.01); *B63B 1/248* (2013.01); *B63B 1/26* (2013.01); *B63B 32/50* (2020.02)

(58) Field of Classification Search
CPC .. B63B 1/24; B63B 1/248; B63B 1/26; B63B 1/28; B63B 2001/281; B63B 1/283; B63B 1/285; B63B 1/286; B63B 1/32; B63B 32/20; B63B 32/50; B63B 32/60; B63B 32/62; B63B 32/64; B63B 34/40
See application file for complete search history.

(56) References Cited

U.S. PATENT DOCUMENTS

| | | | | |
|---|---|---|---|---|
| 2,452,280 A | | 10/1948 | Zahller | |
| 2,707,986 A | | 5/1955 | Johnson | |
| 2,721,088 A | | 10/1955 | Ritter, Jr. | |
| 3,121,890 A | * | 2/1964 | Rumsey, Jr. | B63B 32/20 441/70 |
| 3,260,232 A | | 7/1966 | Douglas | |
| 3,325,179 A | | 6/1967 | Bissett | |
| 4,014,283 A | | 3/1977 | Crnogorac | |
| 4,193,609 A | | 3/1980 | Bissett | |
| 4,260,036 A | | 4/1981 | Bissett | |
| D261,022 S | | 9/1981 | Hoskins | |
| 4,421,193 A | | 12/1983 | Bissett | |
| 5,100,354 A | | 3/1992 | Woolley et al. | |
| 5,211,594 A | * | 5/1993 | Barrows | B63B 32/20 441/79 |
| 5,249,998 A | | 10/1993 | Woolley et al. | |
| 5,309,861 A | | 5/1994 | Mardikian | |

(Continued)

FOREIGN PATENT DOCUMENTS

| | | | | |
|---|---|---|---|---|
| DE | 2610790 A1 | * | 9/1977 | B63B 1/24 |
| DE | 102018215176 A1 | * | 3/2020 | B63B 32/10 |

*Primary Examiner* — Ajay Vasudeva

(74) *Attorney, Agent, or Firm* — Quickpatents, LLC; Kevin Prince

(57) ABSTRACT

A hydrofoil for a user on a body of water includes a fuselage with a V-shaped front wing and a rear stabilizer. A mast has a lower end projecting upwardly from the fuselage and an upper end fixed with an elongated deck such that the deck is parallel to the fuselage. In use, the user is pulled forward in the body of water by either a towing device, an impeller device, wave swells, or the like, such that the front wing, through hydrofoil action, raises the deck above a surface of the water. As the deck raises higher above the water, the distal tips of the front wing surface and lose lift, stabilizing the elevation of the deck above the water.

6 Claims, 3 Drawing Sheets

(56) References Cited

U.S. PATENT DOCUMENTS

| | | | | |
|---|---|---|---|---|
| 5,329,870 | A | 7/1994 | Cook | |
| 5,367,978 | A | 11/1994 | Mardikian | |
| 5,518,080 | A | 5/1996 | Pertile | |
| 5,603,281 | A | 2/1997 | Harvey et al. | |
| 5,911,191 | A | 6/1999 | Burer | |
| 6,179,676 | B1 | 1/2001 | Wilborn et al. | |
| 6,234,856 | B1 | 5/2001 | Woolley | |
| 6,443,786 | B2 | 9/2002 | Woolley | |
| 6,551,158 | B2 | 4/2003 | Murphy | |
| 7,232,355 | B2 * | 6/2007 | Woolley | B63B 1/248 441/65 |
| 10,358,193 | B2 * | 7/2019 | Lobisser | B63B 1/26 |
| 10,668,987 | B1 | 6/2020 | Murphy | |
| 2003/0143906 | A1 | 7/2003 | Murphy | |
| 2011/0275257 | A1 | 11/2011 | Jarnot | |
| 2015/0104985 | A1 | 4/2015 | Langelaan | |
| 2018/0099734 | A1 | 4/2018 | Schibli | |
| 2020/0331562 | A1 * | 10/2020 | Dombois | B63B 1/248 |

* cited by examiner

SURFACE PIERCING HYDROFOIL WING

CROSS-REFERENCE TO RELATED APPLICATIONS

This application claims the benefit of U.S. Provisional Patent Application 62/974,876, filed on Jan. 2, 2020, and is incorporated herein by reference.

STATEMENT REGARDING FEDERALLY SPONSORED RESEARCH AND DEVELOPMENT

Not Applicable.

FIELD OF THE INVENTION

This invention relates to water sports, and more particularly to a personal hydrofoil.

BACKGROUND

Water sports devices that allow a user to ride a deck above body of water are gaining popularity, and my previous water sports devices (disclosed in U.S. Pat. No. 6,551,158 on Apr. 22, 2003 and U.S. Pat. No. 10,668,987 on Jun. 2, 2020, both incorporated herein by reference) teach two such devices. It has been found that such hydrofoils have an instability that, once the deck has been elevated above the body of water with the rider, at speed, the device tends to keep rising because of the hydrofoil action imparted by a water wing below the surface of the water. This makes it difficult for the novice rider to control the device and maintain a set height above the surface of the water while riding. Speed of the towing vehicle is a determining factor, and if the towing vehicle is going too fast the hydrofoil tends to ride too high until the water wing itself tries to rise out of the water, resulting typically in a fall.

Therefore, there is a need for a hydrofoil device that is self-stabilizing once a particular height of the deck is achieved. Such a needed device could be pulled by a variety of towing vehicles or even a kite, or could be self-propelled with an impeller device or through manual pumping action of the user on the deck. The present invention accomplishes these objectives.

SUMMARY OF THE INVENTION

The present device is a hydrofoil for a user on a body of water. A towing apparatus can be used to pull the hydrofoil through the water, such as a power boat, a kite, or the like, having a towing rope and a handle. Alternately, the hydrofoil can be self-propelled with an impeller device, through riding wave swells, or through manual pumping action of the user on the deck.

The hydrofoil includes an elongated fuselage that has a front end and a rear end. A front wing is attached with the front end of the fuselage and preferably assumes a V-shape having a lower portion and distal opposing wing tips, the lower portion fixed with the fuselage. In preferred embodiments the distal tips are curved. A rear stabilizer is adjustably attached with the rear end of the fuselage. A mast has a lower end projecting upwardly from the fuselage and an upper end.

An elongated deck has a top side, a lower side, a front end, and a rear end. The deck is attached with the upper end of the mast, preferably at the lower side or through an aperture in the deck (not shown) and at a top side. The deck is preferably mounted with the mast in such a way that the deck is substantially parallel with the fuselage. In some embodiments the top side of the deck includes at least one foot binding, whereby one or both feet of the user are securable to the deck.

As such, in use, with the user standing on the top side of the deck, the user moves forward in the body of water by either being towed, pushed along by wave swells, or by manual pumping action of the user on the deck, such that the front wing through hydrofoil action raises the deck above a surface of the water. The user is able to raise the deck further by leaning backward, the wings, thereby being tilted upward to deflect the water downward to further raise the deck. Conversely, the user is able to lower the deck by leaning forward. The user can steer the hydrofoil left and right by leaning left or leaning right, respectively, or by imparting a twisting force to the deck and hydrofoil.

With the V-shaped front wing, as the deck raises higher above the surface of the water, the distal tips of the front wing surface and lose lift. As more of the front wing is pulled up out of the water, more lift is lost on the hydrofoil, stabilizing the elevation of the deck above the surface of the water depending on the speed of the hydrofoil through the water and the angle of the wings, with respect to the surface of the water.

As such, in use the user is pulled forward in the body of water by a towing apparatus or by wave swells, such that the front wings through hydrofoil action raise the deck above the surface of the water. As the deck raises higher above the surface of the water, a top-most front wing surfaces and loses lift. As more of the front wings are pulled up out of the water, more lift is lost on the hydrofoil, stabilizing the elevation of the deck above the surface of the water depending on the speed of the hydrofoil through the water and the angle of the wings, with respect to the surface of the water. The user can also impart a pumping action to the deck to move the hydrofoil through the water.

The present device is a hydrofoil that is self-stabilizing once a particular height of the deck is achieved. The present invention can be pulled by a variety of towing vehicles or even a kite, or can be self-propelled with an impeller device or through manual pumping action of the user on the deck. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Figure 1:
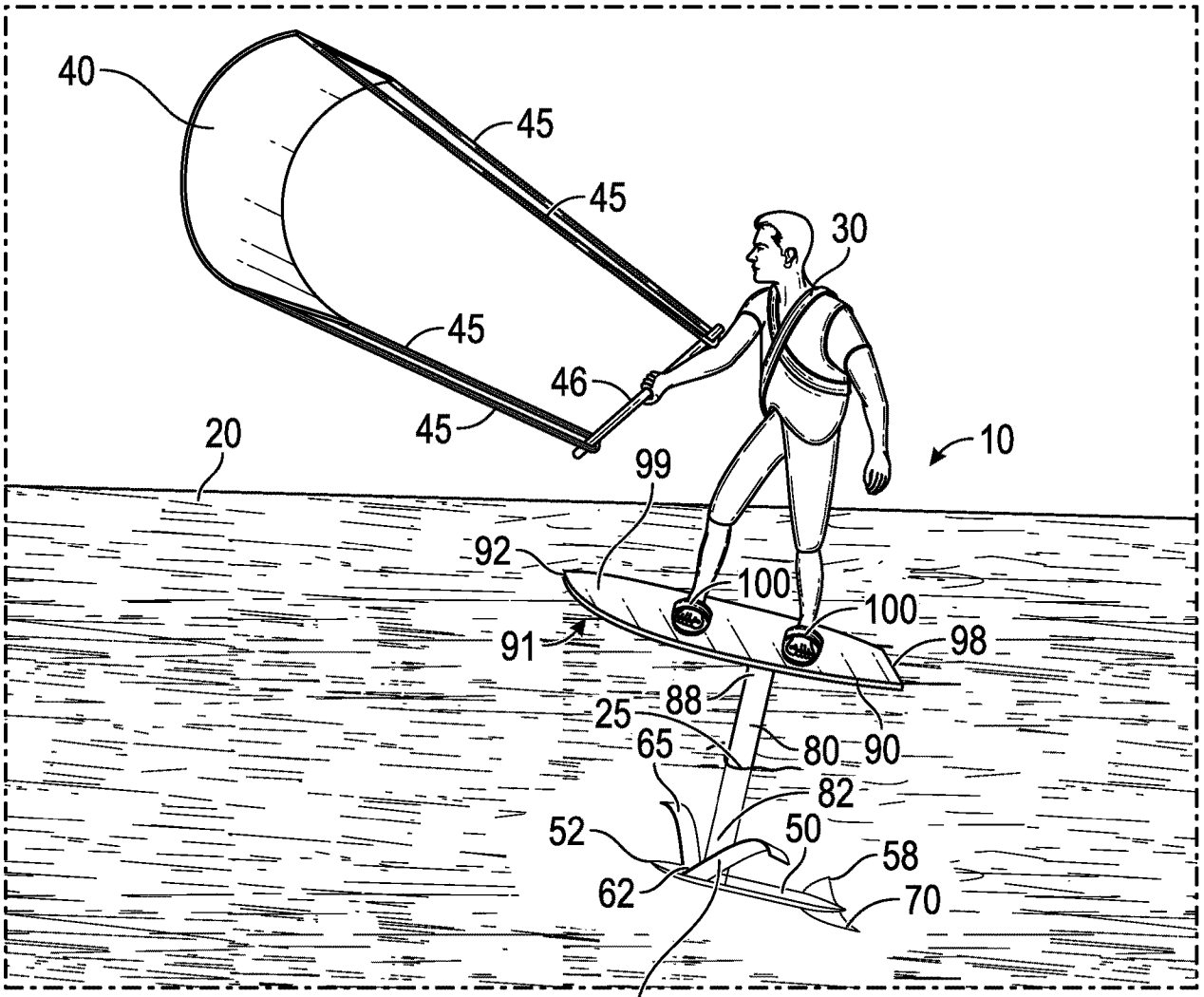
FIG. 1 is a perspective view of the invention as used by a user on a body of water.
Figure 2:
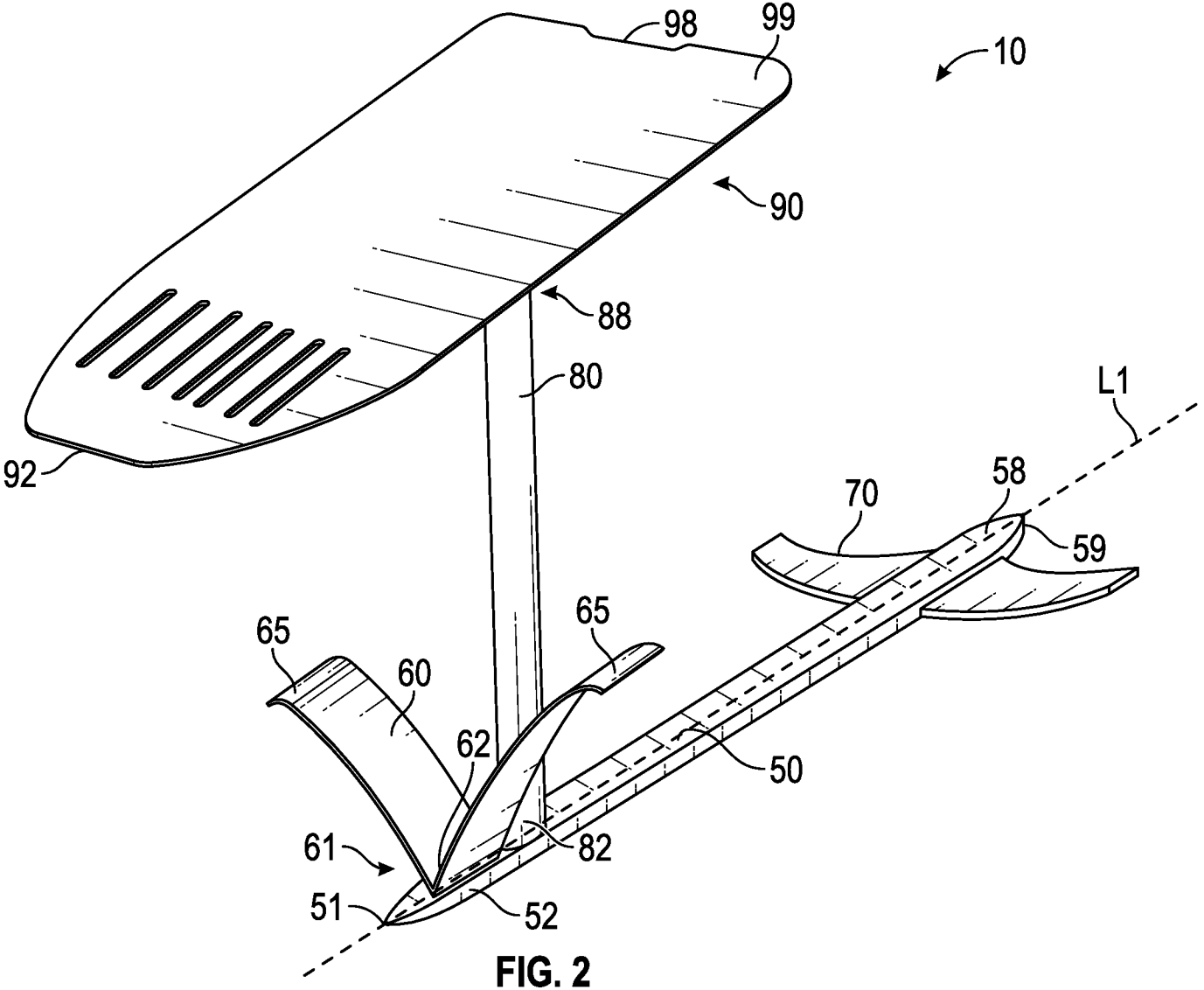
FIG. 2 is a front perspective view of the invention.
Figure 3:
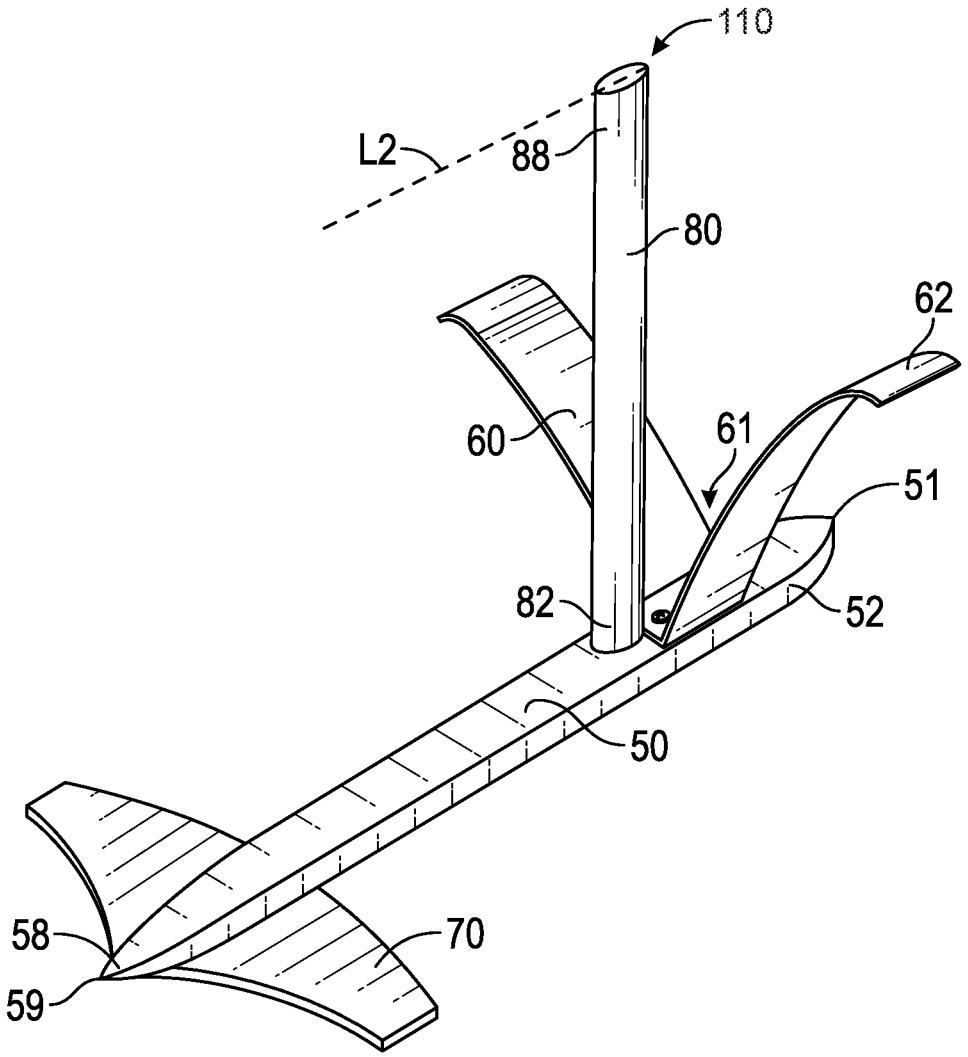
FIG. 3 is a rear perspective view of the invention.

FIGS. 1-3 illustrate a hydrofoil 10 for a user 30 and a towing apparatus 40, which is typically a power boat (not shown), a kite (FIG. 1), or the like, having a towing rope 45 and a handle 46. The user 30 is towed by the towing apparatus 40 on a body of water 20, such as a lake or an ocean. Alternately the user 30 can move the hydrofoil 10 through the body of water 20 by imparting a pumping action to the hydrofoil 10, or by allowing the hydrofoil to catch ocean or wave swells.

The hydrofoil 10 includes an elongated fuselage 50 that has a front end 52 and a rear end 58. The front end 52 preferably terminates at a point 51, and the rear end 58 preferably terminates at a point 59, making the fuselage 50 more aquadynamic as it moves within the water 20 generally in a direction along its longitudinal axis $L_1$. The fuselage 50 is preferably made from a strong, rigid metal, wood, fiberglass, carbon fiber, plastic material, or the like.

A front wing 60 is attached with the front end 52 of the fuselage 50 and preferably assumes a V-shape 61 having a lower portion 62 and distal opposing wing tips 65. In preferred embodiments the distal tips 65 are curved. A rear stabilizer 70 is attached with the rear end 58 of the fuselage 50. Preferably the front wing 60 and the rear stabilizer 70 are attached with the fuselage 50 by mechanical fasteners (not shown), and in the case of the rear stabilizer 70, preferably mechanical fasteners that allow adjustment of an angle of the rear stabilizer 70 and position of the rear stabilizer 70 on the fuselage 50. The rear stabilizer 70 may be a horizontal wing shape as illustrated, or may itself assume a V-shape 61 similar to that of the front wing 60. Other forms of the rear stabilizer 70 may be utilized as is known, or becomes known, in the art.

A mast 80 has a lower end 82 projecting upwardly from the fuselage 50 and an upper end 88. Preferably a horizontal cross-section across the mast 80 has a cross-sectional shape 110 of a vesica piscis, or a "pointed oval," having a longitudinal axis $L_2$ parallel to that of the fuselage $L_1$. Such a cross-sectional shape 110 may also be a teardrop shape, a diamond shape, or the like as is known in the art. The wings 60,70 and mast 80 are preferably made from a strong and rigid metal, wood, plastic, carbon fiber, fiberglass material, or the like. In some embodiments the mast 80 may include an impeller device (not shown) that can be used by the user 30 to propel the hydrofoil 10 forward in the water 20. Such an impeller device is taught, for example, in my previous U.S. Pat. No. 10,668,987 of Jun. 2, 2020.

An elongated deck 90 has a top side 99, a lower side 91, a front end 92, and a rear end 98. The deck 90 is attached with the upper end 88 of the mast 80. The deck 90 is preferably mounted with the mast 80 in such a way that the deck 90 is substantially parallel with the fuselage. In some embodiments the top side 99 of the deck 90 includes at least one foot binding 100, whereby one or both feet of the user 30 are secured to the deck 90. The elongated deck 90 is preferably made with a strong and rigid wood, metal, plastic, carbon fiber, fiberglass material, or the like. Preferably the mast 80 is attached with the deck 90 by mechanical fasteners (not shown), as is known in the art. In some embodiments a seat (not shown) may be included fixed with the deck, as is known in the art such as in my previous U.S. Pat. No. 6,551,158 of Apr. 22, 2003, and my previous U.S. Pat. No. 10,668,987 of Jun. 2, 2020.

As such, in use, the user 30 is propelled forward in the body of water 20 with either the towing apparatus 40, by ocean swells, or by the impeller device, such that the front wing 60 through hydrofoil action raises the deck 90 above a surface 25 of the water 20. The user 30 is able to raise the deck 90 further by leaning backward, the wings 60,70 thereby being tilted upward to deflect the water 20 downward to further raise the deck 90. Conversely, the user 30 is able to lower the deck 90 by leaning forward. The user 30 can steer the hydrofoil left and right by leaning left or leaning right, respectively, or by imparting a twisting action to the deck 90.

With the V-shaped front wing 60, as the deck 90 raises higher above the surface 25 of the water 20, the distal tips 65 of the front wing 60 surface and lose lift. As more of the front wing 60 is pulled up out of the water, more lift is lost on the hydrofoil, stabilizing the elevation of the deck 90 above the surface 25 of the water 20 depending on the speed of the hydrofoil 10 through the water 20 and the angle of the wings 60,70 with respect to the surface 25 of the water 20. Preferably the distal tips 65 of the front wing 60 are curved down so as to be substantially parallel to the deck 90.

While a particular form of the invention has been illustrated and described, it will be apparent that various modifications can be made without departing from the spirit and scope of the invention. For example, the specific shapes of the fuselage 50, wings 60,70, masts 80, and deck 90 are shown by way of example only. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above.

The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A hydrofoil for a user in a body of water, comprising:

a fuselage having a front end and a rear end;

a front wing with distal tips, the front wing being generally V-shaped and fixed at a lower portion thereof proximate the front end of the fuselage, wherein the front wing is spaced away from and attached aft of the front end of the fuselage;

a rear stabilizer rigidly attached with the rear end of the fuselage;

a mast having a lower end and an upper end, wherein the mast is disposed intermediate the front wing and the rear stabilizer and projects substantially vertically from the fuselage, and wherein the lower end of the mast is disposed closer to the front wing than to the rear stabilizer; and a deck having a top side, a lower side, a front end, and a rear end, the deck attached with the upper end of the mast and being generally parallel to the fuselage;

whereby the user riding on the deck may be pulled forward in the body of water with a tow rope, by wave swells, or by imparting a pumping action to the deck, such that when propelled forward the front wing through hydrofoil action raises the deck above a surface of the water such that as the deck rises out of the water, the distal tips of the front wing surface out of the water and lose lift, thereby stabilizing the elevation of the deck above the surface of the water, the user able to raise the deck by leaning backward, to lower the deck by leaning forward, and to steer the hydrofoil by leaning left or right or imparting a twisting force to the hydrofoil.

2. The hydrofoil of claim 1 wherein the mast has a cross sectional shape of a vesica piscis with a longitudinal axis parallel to that of the fuselage.

3. The hydrofoil of claim 1 wherein the top side of the deck includes at least one foot binding, whereby one or both feet of the user are secured to the deck.

4. The hydrofoil of claim 1 wherein the front end of the fuselage is pointed.

5. The hydrofoil of claim 1 wherein the rear end of the fuselage is pointed.

6. The hydrofoil of claim 1 wherein the distal tips of the front wing are substantially parallel to the deck.

* * * * *